US009303434B2

(12) United States Patent
Tarquinio

(10) Patent No.: US 9,303,434 B2
(45) Date of Patent: Apr. 5, 2016

(54) DOOR LATCH DEVICE

(71) Applicant: Dominick Tarquinio, Staten Island, NY (US)

(72) Inventor: Dominick Tarquinio, Staten Island, NY (US)

( * ) Notice: Subject to any disclaimer, the term of this patent is extended or adjusted under 35 U.S.C. 154(b) by 58 days.

(21) Appl. No.: 14/120,102

(22) Filed: Apr. 26, 2014

(65) Prior Publication Data

US 2014/0333075 A1 Nov. 13, 2014

Related U.S. Application Data

(60) Provisional application No. 61/822,381, filed on May 12, 2013.

(51) Int. Cl.
*E05B 63/20* (2006.01)
*E05B 63/18* (2006.01)

(52) U.S. Cl.
CPC ..... *E05B 63/18* (2013.01); *Y10T 292/546* (2015.04)

(58) Field of Classification Search
CPC ... Y10T 292/79; Y10S 292/02; E05B 17/005; E05B 65/1013; E05B 17/22; E05B 63/18; E05C 19/022
USPC ..... 292/333, DIG. 2, 169.12
See application file for complete search history.

(56) References Cited

U.S. PATENT DOCUMENTS

| | | | | |
|---|---|---|---|---|
| 3,773,369 | A | 11/1973 | Wersonick | |
| 4,159,838 | A * | 7/1979 | Wilzig | E05B 17/2038 292/150 |
| 4,453,752 | A * | 6/1984 | McKann | E05B 15/024 292/341 |
| 4,478,444 | A * | 10/1984 | Kurz | E05B 63/20 292/333 |
| 6,082,790 | A * | 7/2000 | Mossotti | E05B 17/005 292/1 |
| 6,406,076 | B1 | 6/2002 | Zarzycki, Jr. | |
| 7,240,931 | B1 * | 7/2007 | Casey | E05B 15/024 292/288 |
| 7,770,420 | B2 | 8/2010 | Carr | |
| 8,177,267 | B2 | 5/2012 | Kuehn | |
| 2012/0292929 | A1 | 11/2012 | Ploskunak | |
| 2013/0273302 | A1 | 10/2013 | Ambrosi | |

* cited by examiner

*Primary Examiner* — Mark Williams
(74) *Attorney, Agent, or Firm* — Patrick P. Zaretski

(57) ABSTRACT

A slidable device allows a door to be locked but prevented from latching into the doorjamb until a sliding mechanism releases the door latch.

1 Claim, 7 Drawing Sheets

DOOR LATCH DEVICE

RELATED APPLICATION DATA

This application claims the benefit of U.S. Provisional Application No. 61/822,381 filed May 12, 2013, entitled "Door Latch Device," which is herein incorporated by reference.

FIELD OF THE INVENTION

The present invention is in the technical field of door anti-latch devices. More particularly, the present invention is in the technical field of sliding door anti-latch devices that allow rapid engagement or disengagement of the latch prevention mechanism.

BACKGROUND OF THE INVENTION

When an educational institution goes into a lockdown mode, the teacher has to locate the classroom door key and must open the door and step into the hallway in order to lock the door from the outside. This places the classroom at risk and can take critical time away from other lockdown procedures, such as shutting off lights, pulling down window shades, and covering the door window. It would be beneficial to provide a device or means by which a teacher can lock the door within a few seconds without the need to open the door, thereby eliminating the time it takes to find the door key, open the door, lock the door from the outside, and step back into the classroom, all steps that compromise the safety of both the teacher and the students in the room. On the outside of the door, it would further be advantageous to provide a visual indicator on such a device to allow a safety officer or other personnel to determine quickly whether the door is locked or unlocked during lockdown mode.

SUMMARY OF THE INVENTION

The present invention comprises a sliding door latch prevention device that can prevent a door from latching into the doorjamb when closed but can be slid out of the way quickly to allow the door to latch and lock when needed.

DETAILED DESCRIPTION OF THE INVENTION

Figure 1:
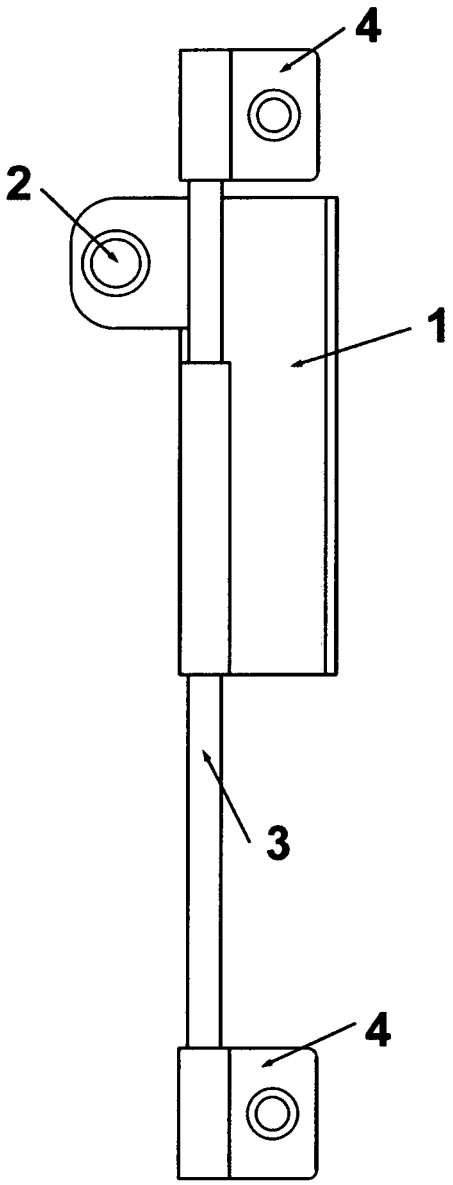
FIG. 1 illustrates a front view of the sliding door latch prevention device of the present invention.

Referring now to the invention in more detail, in FIGS. 1 through 7, there is generally shown a sliding door latch prevention device to be used with a door 8 having a door latch 6 and a door handle assembly 7, this device comprising a sliding latch guard plate 1 bearing an actuator knob 2 on the side of the guard plate 1 facing the inner side of the door 8; a pair of guide rails 3; guide rail supports 4; and mounting hardware comprising metal screws and adhesive pads 5.

Figure 2:
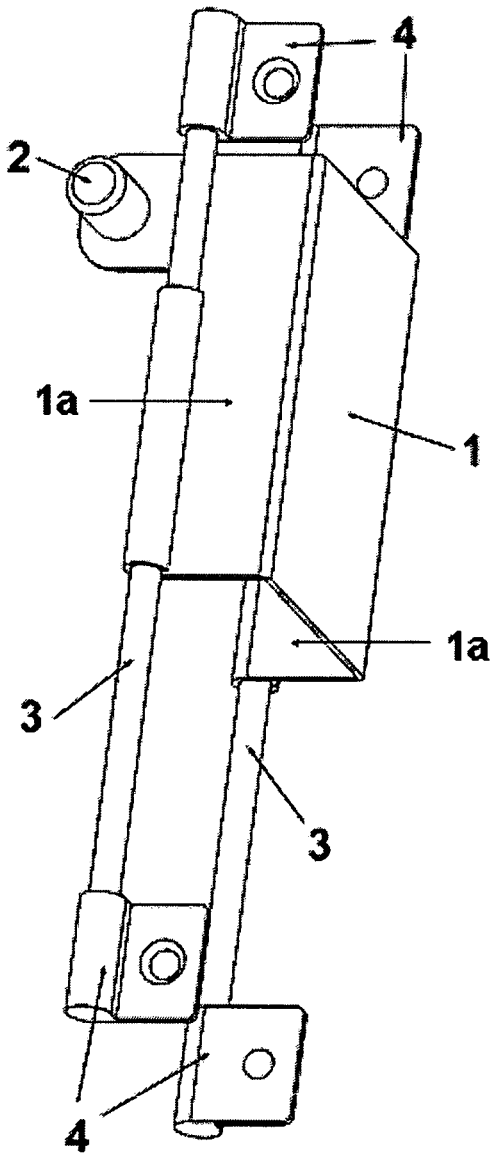
FIG. 2 shows a perspective view of the sliding door latch prevention device of the present invention.
Figure 3:
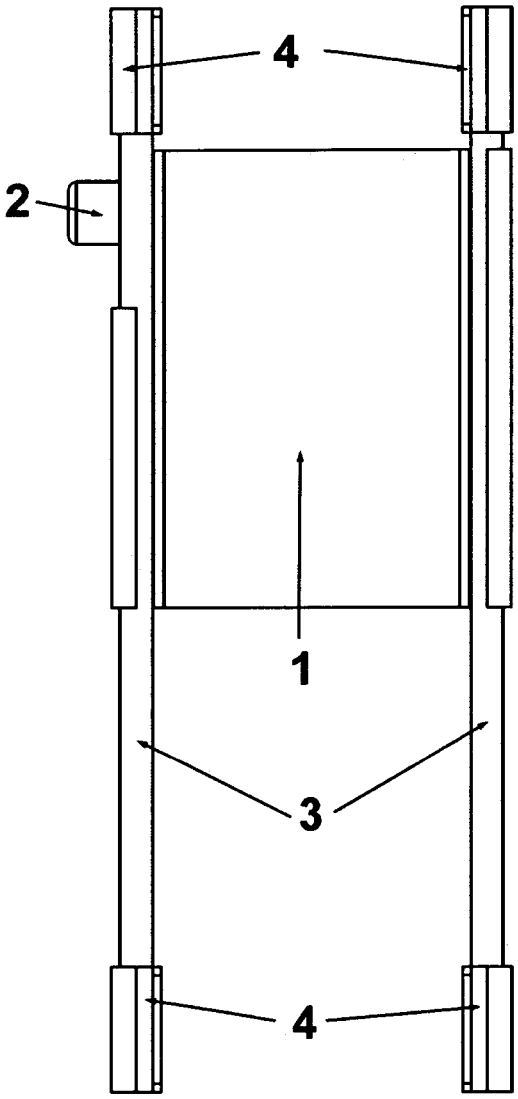
FIG. 3 depicts a side view of the sliding door latch prevention device of the present invention.

As seen in FIGS. 1 through 3, the sliding door latch prevention device has guide rail supports 4 to affix the device to the door's inner and outer surfaces. The guide rail supports 4 are made from a thicker material than the sliding latch guard plate 1, or contain raised features, such that the impact of the door against the doorjamb is withstood by the guide rail supports 4 in order to protect the sliding latch guard plate 1 from damage and to also prevent it from jamming between the door and doorjamb. A pair of guide rails 3 allows a sliding latch guard plate 1 having edges 1*a* that wrap around the door and that are flush against the inner and outer sides of the door affixed thereto to slide up and down along the surface of the door facing the doorjamb through the use of an actuator knob 2. The guide rail supports 4 also serve to limit the range of motion of the sliding latch guard plate 1 relative to the guide rails 3. The sliding latch guard plate 1, guide rails 3, and guide rail supports 4 of the present invention are made of metal, while the actuator knob 2 is made of metal or plastic.

Figure 4:
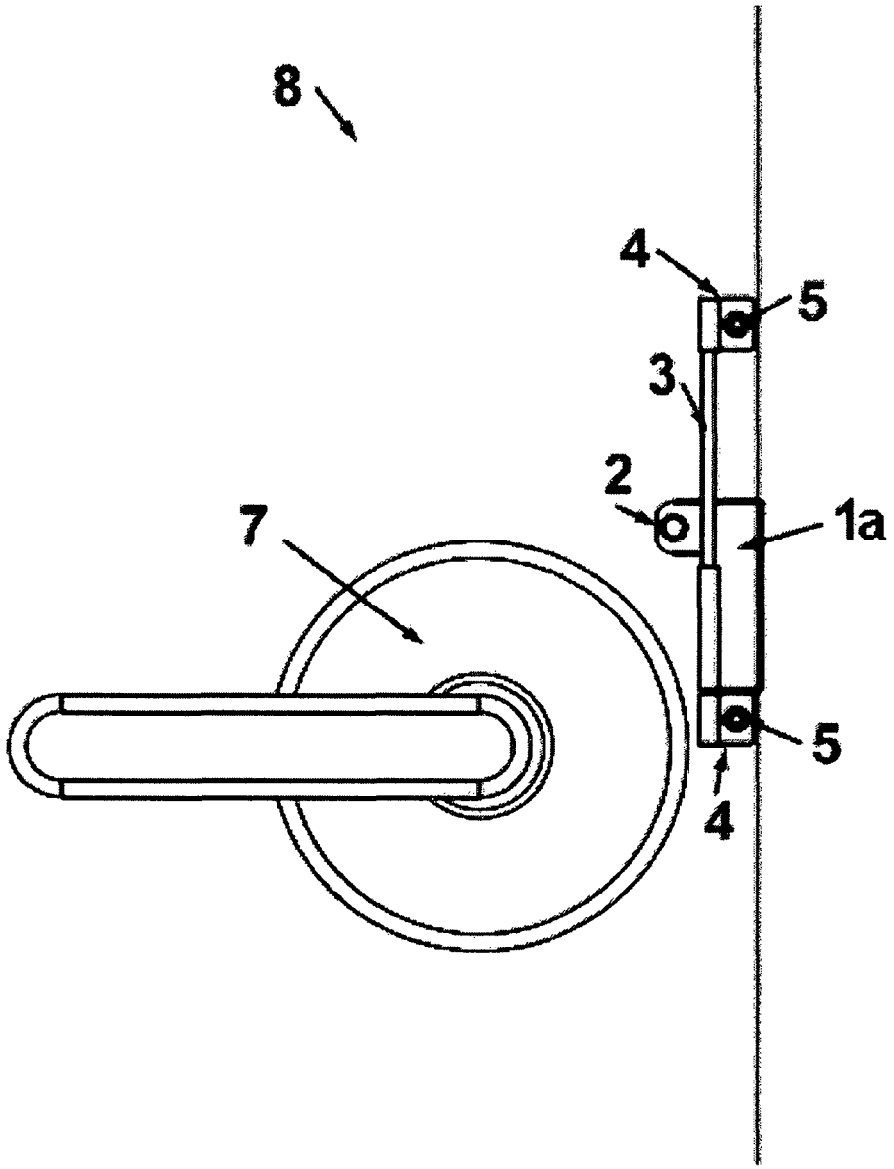
FIG. 4 illustrates a front view of the sliding door latch prevention device of the present invention mounted on a door in the latch-disabled configuration
Figure 5:
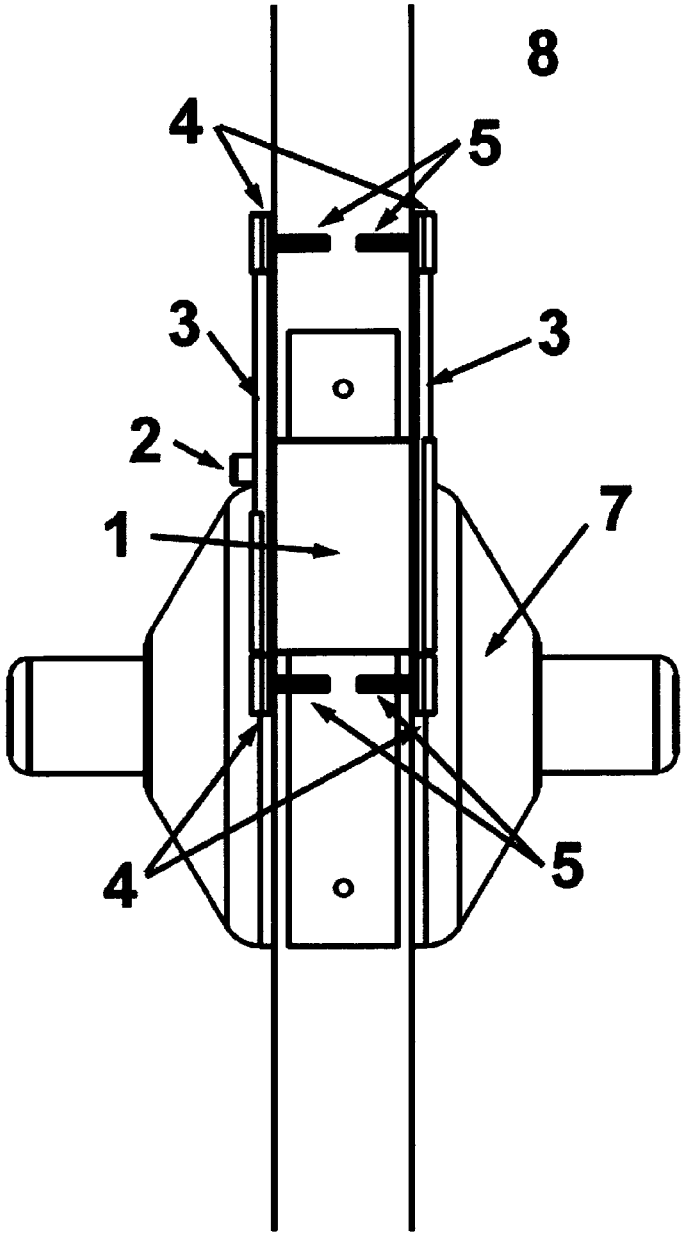
FIG. 5 depicts a side view of the sliding door latch prevention device of the present invention mounted on a door in the latch-disabled configuration.
Figure 6:
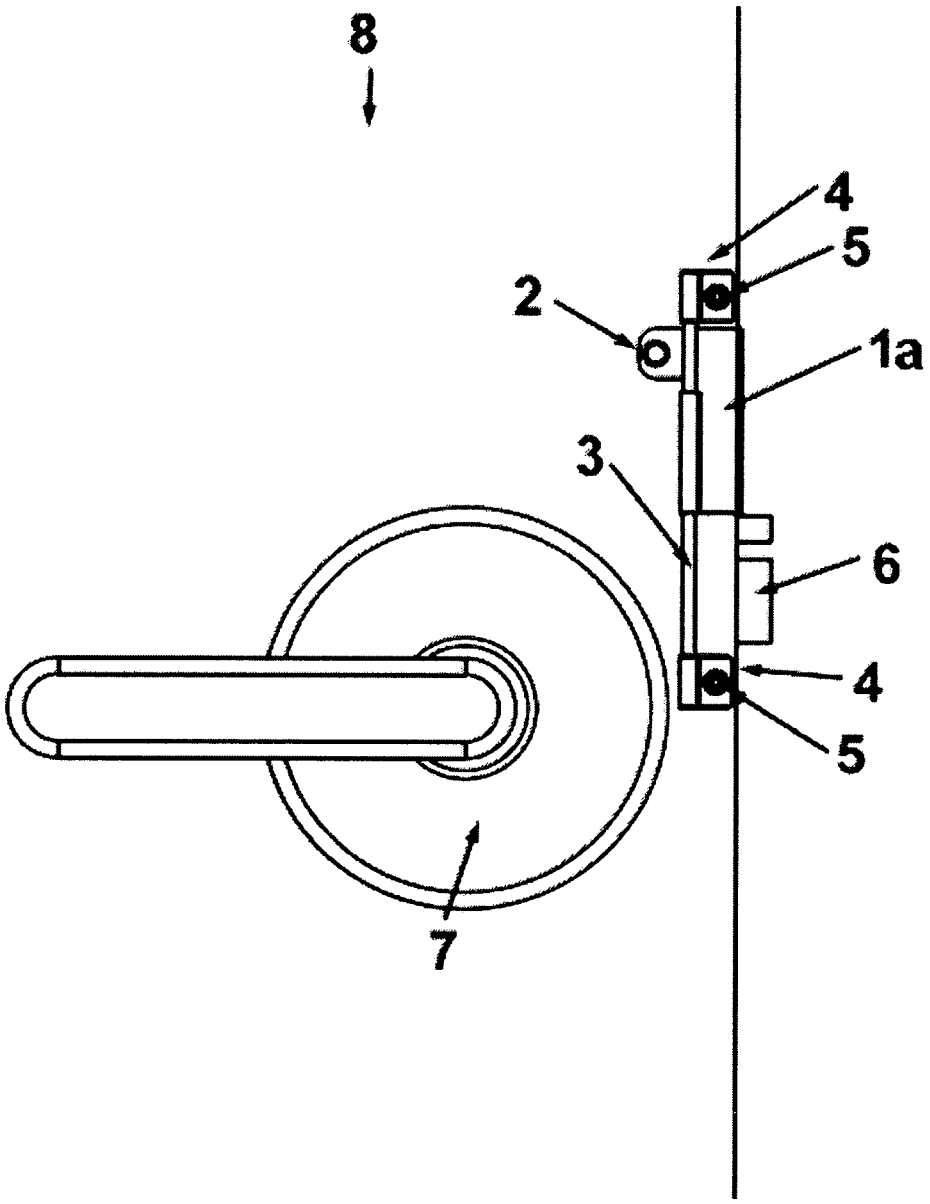
FIG. 6 shows a front view of the sliding door latch prevention device of the present invention mounted on a door in the latch-enabled configuration.
Figure 7:
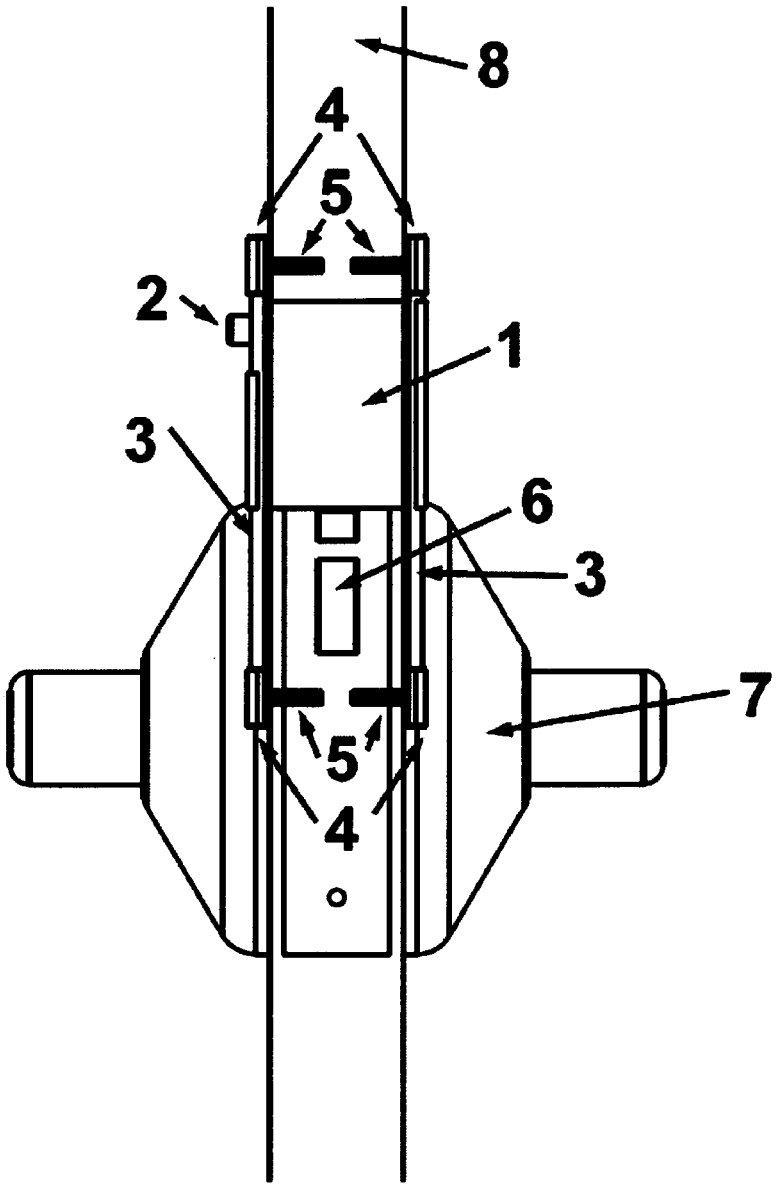
FIG. 7 illustrates a side view of the sliding door latch prevention device of the present invention mounted on a door in the latch-enabled configuration.

In FIGS. 4 and 5, the sliding door latch prevention device is shown in the engaged configuration wherein the door latch is covered and restrained by the sliding latch guard plate 1, preventing the door latching with the doorjamb. Alternatively, in FIGS. 6 and 7, the sliding door latch prevention device is shown in the disengaged configuration wherein the door latch 6 is no longer constrained or prevented from latching with the doorjamb by the sliding latch guard plate 1. Mounting hardware 5 comprises metal screws and adhesive pads.

As seen in FIGS. 1 through 7, the sliding door latch prevention device of the present invention functions by having the sliding latch guard plate 1 cover a door latch 6 to prevent an otherwise locked door 8 from latching with the doorjamb when closed. In addition to covering the door latch 6, the sliding latch guard plate had edges 1*a* that wrap around the door 8 and that are flush against the inner and outer sides of the door 8. The door 8 can be allowed to latch and lock by either upward or downward manual action on the actuator knob 2, depending on where the device is affixed on a door 8 relative to the door handle assembly 7 and door latch 6, which causes the sliding latch guard plate 1 to slide along the guide rails 3 until the door latch 6 is no longer restrained and can spring outwards from the door 8 to latch into the doorjamb, allowing the door 8 to be locked rapidly without the need for a key. To reset the device, the unlocked door handle assembly 7 is rotated to retract the door latch 6, after which the sliding latch guard plate 1 can then be reversibly engaged through upward or downward manual action on the actuator knob 2 to cover the door latch 6, thereby preventing the door latch 6 from latching with the doorjamb.

In a preferred embodiment of the present invention, a visual indicator sticker or other marking is uncovered on the outside surface of the door by the sliding door latch prevention device when the device is in a locked state, providing a quick visual indication of door lock status. This indicator can also be made of a reflective or fluorescent material to allow easy determination of lock status in the dark.

The sliding door latch prevention device of the present invention is primarily intended to increase the security of classrooms, university lecture halls, government offices, and hospitals, but can be applied to many other situations as well. For example, classroom doors can be locked to prevent entry from the outside of the room, but must be easy to open from within. The sliding door latch prevention device of the present invention permits the door to be locked in advance but prevents latching into the doorjamb such that the door can easily be opened from either side. In the event of an emergency such as a school lockdown, the sliding door latch prevention device of the present invention can be quickly slid to release the door latch, locking the door and preventing access from the outside of the room. The sliding door latch prevention device of the present invention does not interfere with egress from the occupied side of the room in compliance with fire code regulations. The sliding door latch prevention device of the present invention does not require alteration of existing door hardware and can easily be mounted to standard-sized doors with metal or wooden door frames.

The advantages of the present invention include, without limitation, the ability to close a locked door while preventing the latch from engaging with the doorjamb. The sliding door latch prevention device of the present invention is especially well-suited for situations where the door can only be locked from the outside of the room through the use of a key, but it would be desirable to lock the door quickly from the inside of the room without having to open the door and step outside. The latch guard plate can be quickly engaged to release the door latch and allow the door to be immediately locked and latched from inside the room without the need to step outside first to gain access to the door keyhole.

The foregoing discussion discloses and describes merely exemplary embodiments of the present invention. One skilled in the art will readily recognize from such discussion, and from the accompanying claims, that various changes, modifications and variations can be made therein without departing from the spirit and scope of the invention as defined in the following claims. Furthermore, while exemplary embodiments have been expressed herein, others practiced in the art may be aware of other designs or uses of the present invention. Thus, while the present invention has been described in connection with exemplary embodiments thereof, it will be understood that many modifications in both design and use will be apparent to those of ordinary skill in the art, and this application is intended to cover any adaptations or variations thereof It is therefore manifestly intended that this invention be limited only by the claims and the equivalents thereof.

The invention to be claimed is:

1. A sliding door latch prevention device to block and selectively prevent a door latch from locking into a doorjamb while simultaneously allowing rapid disengagement of the anti-latch mechanism, comprising a sliding latch guard plate to be affixed to the door, said plate having edges that wrap around the door and that are flush against the inner and outer sides of the door; an actuator knob for said plate to be located on the edge of the guard plate that is flush against the inner side of the door; a pair of guide rails that allow the guard plate to be slidably engaged, said guide rails to be affixed to the inner and outer sides of the door; guide rail supports to permit affixing the guide rails to the inner and outer sides of the door; and mounting hardware to affix the guide rail supports to the door.

* * * * *